US006220920B1

(12) United States Patent
Baier

(10) Patent No.: US 6,220,920 B1
(45) Date of Patent: Apr. 24, 2001

(54) YO-YO WITH ADJUSTABLE SLOT WIDTH

(75) Inventor: Harry Baier, Gutach (DE)

(73) Assignee: Yomega Corporation, Fall River, MA (US)

( * ) Notice: Subject to any disclaimer, the term of this patent is extended or adjusted under 35 U.S.C. 154(b) by 0 days.

(21) Appl. No.: 09/015,155

(22) Filed: Jan. 29, 1998

(51) Int. Cl.[7] ..... A63H 1/30; A63H 1/06
(52) U.S. Cl. ..... 446/250; 446/249
(58) Field of Search ..... 446/250, 251, 446/252, 247, 248, 249, 236

(56) References Cited

U.S. PATENT DOCUMENTS

| | | | | |
|---|---|---|---|---|
| 926,083 | * | 6/1909 | Vuillaume | 446/255 |
| 1,419,402 | * | 6/1922 | Mosher | 446/251 |
| 2,605,584 | * | 8/1952 | Perker et al. | 446/250 |
| 2,891,351 | * | 6/1959 | Madaras et al. | 446/250 |
| 4,130,962 | * | 12/1978 | Ennis | 446/250 |
| 4,207,701 | * | 6/1980 | Kuhn | 446/250 |
| 5,100,360 | * | 3/1992 | Kuhn et al. | 446/250 |
| 5,254,027 | * | 10/1993 | McAvoy | 446/250 |
| 5,653,481 | * | 8/1997 | Alderman | 285/363 |
| 5,813,897 | * | 9/1998 | Van Dan Elzen et al. | 446/250 |

FOREIGN PATENT DOCUMENTS

| | | | | |
|---|---|---|---|---|
| 29712814U1 | | 9/1997 | (DE) . | |
| 745712 | * | 5/1933 | (FR) | 446/250 |

* cited by examiner

*Primary Examiner*—D. Neal Muir
(74) *Attorney, Agent, or Firm*—Arthur Z. Bookstein

(57) ABSTRACT

A yo-yo incorporates a construction that enables the gap between the yo-yo halves to be adjusted simply and quickly. The halves of the yo-yo are threadably mounted on the ends of the yo-yo axle. The yo-yo halves are biased apart axially to maintain firm frictional contact between the yo-yo halves and the axial. The gap may be adjusted simply by rotating the yo-yo halves with respect to each other. The inwardly facing surfaces of the yo-yo halves also incorporate angular relationships to facilitate yo-yo play.

13 Claims, 4 Drawing Sheets

YO-YO WITH ADJUSTABLE SLOT WIDTH

FIELD OF THE INVENTION

This invention relates to yo-yos.

BACKGROUND OF THE INVENTION

The typical construction of a tethered aerial top, commonly referred to as a yo-yo, includes an axle that joins a pair of spaced yo-yo halves and a string that is attached to the axle and can extend radially outwardly through the gap between the spaced yo-yo halves. The other free end of the string is controlled and manipulated by the user to perform various maneuvers and tricks. Many of such maneuvers rely on the ability of the yo-yo to "sleep", that is, to spin while attached to the end of the string without winding the string about the axle and returning to the user. Toward the conclusion of the maneuver, when it is usually desired to cause the yo-yo to return to the user by winding the string about the axle, the user may jiggle the string in a manner that briefly releases the tension on the string. During the brief period that the string may be tension-free and is relatively loose within the gap between the yo-yo halves, the loose string can become frictionally caught between the inwardly facing surfaces of the yo-yo halves. The rotational inertia of the yo-yo halves then causes the yo-yo to climb along the string toward the user, winding the string about the axle as the yo-yo returns to the user. The physics and function of the yo-yo is described in a publication, "The Yo-Yo: A Toy Flywheel" by Wolfgang Büzger, *American Scientist*, Vol. 72, Par.-Apr. 1984, pp. 137–142.

The width of the gap between the yo-yo halves is critical to proper control of the yo-yo. If the gap is too small, the yo-yo may not sleep, tending, instead, to frictionally grip the string notwithstanding the presence of tension in the string. If the gap is too wide, the inwardly facing surfaces of the yo-yo halves may not be able to engage the string with sufficient friction. Additionally, the width of the gap between the yo-yo halves also affects the precision with which the yo-yo will tend to rotate in a plane. If the gap is too wide, the yo-yo may precess out of a desired plane, resulting in undesirable interference between one of the yo-yo halves and the string, often near the periphery of the yo-yo halves.

Even if the yo-yo gap is set to what might ordinarily be considered a proper gap, with all other components properly balanced and aligned, changing atmospheric conditions can affect the performance of the yo-yo. Most yo-yo strings are formed from cotton that tends to absorb moisture from the air. Consequently, the string may tend to swell in the presence of higher humidity and may tend to shrink in the presence of lower humidity. The humidity also may affect the surface characteristics of the string fibers that, in turn, may affect the frictional interaction between the string and the inner surfaces of the yo-yo halves.

It would be desirable, therefore, to provide a yo-yo in which the gap between the inwardly facing surfaces of the yo-yo could be adjusted in order to maximize the ability of the yo-yo to perform as desired in a particular environment. Adjustment of the gap may, in many cases, compensate for differences in frictional characteristics between the yo-yo string and the inwardly facing, string-engaging surfaces of the yo-yo, whether those characteristics are affected by the composition of the string, the inwardly facing surfaces, atmospheric conditions or any other influence that may affect yo-yo performance. The desirability of providing a yo-yo that is adjustable to compensate for such variations in conditions of use has been recognized and is described in U.S. Pat. No. 5,100,361 (Kuhn). The Kuhn patent describes an arrangement in which the gap between the string-engaging surfaces of the yo-yo can be adjusted. The mechanism described in the Kuhn '361 patent requires that the yo-yo be disassembled in order to provide access to internally adjustable members, that are adjusted by the use of a tool, such as a screw driver. Disassembly to expose an internal, tool-adjustable mechanism presents considerable inconvenience to the user in that play must be interrupted for a considerable period of time. Moreover, even if an adjustment is made, it often may be desirable or necessary to make further fine adjustments to obtain optimum performance. Each such fine adjustment necessarily would require one or more subsequent disassemblies, readjustments and reassemblies of the yo-yo. It would be desirable, therefore, to provide an adjustable-gap yo-yo in which the gap can be adjusted immediately, without requiring disassembly, internal adjustment and reassembly of the yo-yo. It is among the general objects of the invention to provide such a device.

SUMMARY OF THE INVENTION

The invention is incorporated in a yo-yo having an axle with ends that are rotatably attached to the yo-yo halves. The location and spacing of the yo-yo halves is adjustable simply by rotating the yo-yo halves relative to each other. A mechanism is provided to maintain the angular position of the yo-yo halves while the yo-yo is in use but also allows the angular orientation to be adjusted. The mechanism causes the gap between the yo-yo halves to vary as a function of the relative angular position of the halves. In the illustrative embodiment, the connection is threaded. The threaded connection between the yo-yo halves and the axle causes the gap to widen or become narrower, accordingly. The relative angular orientation of the yo-yo halves on the axle and with respect to each other is maintained by an arrangement that applies a firm outward bias in an axial direction to the yo-yo halves, by which the yo-yo halves are urged continually outwardly along the axle. The engaged surfaces of the threads of the axle and the yo-yo half thus are continually pressed axially and firmly against each other. That pressure is applied in sufficient magnitude to develop sufficient friction so that the yo-yo halves will maintain their relative angular position on the axle as the yo-yo spins. The frictional force resulting from the outward bias can be overcome manually and easily simply by manually rotating the yo-yo halves with respect to each other. That enables coarse as well as very fine adjustments in the gap to be made, depending on the extent to which the halves are rotated. The adjustment can be made immediately and accurately with no significant interruption of play. There is no need to disassemble the yo-yo, or to expose its inner components. There is no need for tools.

In another aspect of the invention, the inner faces of the yo-yo halves are contoured so that the more radially inward portion of the gap will be more narrow than the radially outward portion. That enhances the ability of the string to be frictionally engaged when the tension on the string is released momentarily in order to cause the yo-yo to return. The outer region of the inner face is provided with a wider angle that facilitates performance of a certain class of tricks, commonly referred to as "string tricks".

It is among the general objects of the invention to provide an improved yo-yo in which the gap between the yo-yo halves can be easily adjusted.

Another object of the invention is to provide a yo-yo having an adjustable gap that does not require the use of tools or disassembly of the yo-yo.

A further object of the invention is to provide a yo-yo having an adjustable gap in which the adjustment can be made immediately and in precisely controllable increments.

Another object of the invention is to provide a yo-yo that exhibits greater sensitivity to control for returning it from a sleeping condition yet which also enables string tricks to be performed.

An additional object of the invention is to provide a yo-yo in which the inwardly facing surfaces of the yo-yo halves define an inner annular band and an outer annular band wherein the angle defined by the facing inner annular bands is less than the angle defined between the radially outer annular bands.

Still another object of the invention is to provide a yo-yo wherein the yo-yo halves are rotatably threaded and restrained in a selected angular position on the axle by biasing the yo-yo halves outwardly into firm frictional engagement with the yo-yo axle.

DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATIVE EMBODIMENT

Figure 1:
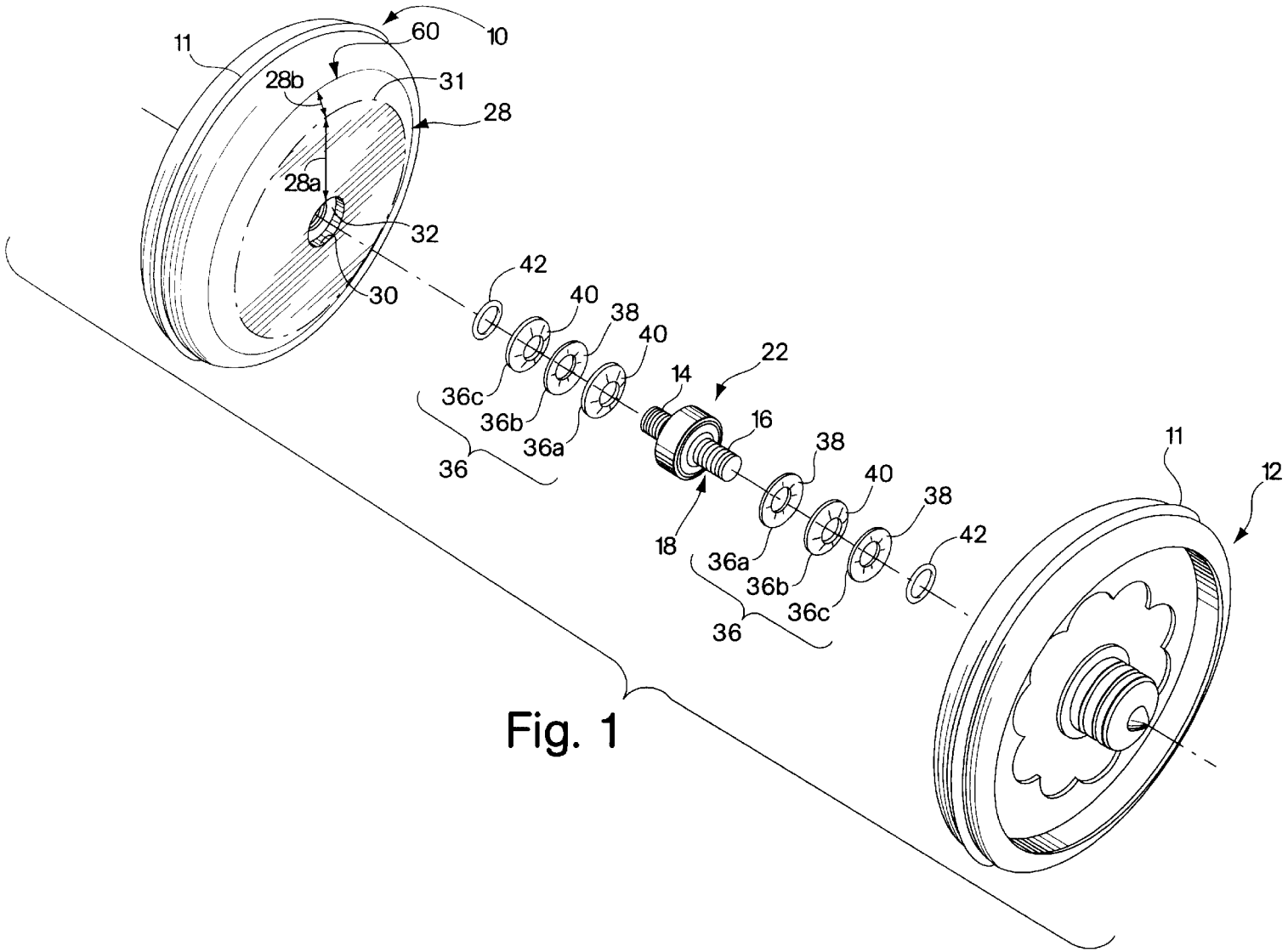
FIG. 1 is an exploded view of the components of a yo-yo incorporating an embodiment of the invention.

The yo-yo includes a pair of yo-yo halves 10, 12 that are threaded onto the threaded ends 14, 16 of an axle 18. The axle 18 preferably is formed from a suitable metal, such as stainless steel and may include a central segment 20 that is unthreaded. The yo-yo also may include a bearing 22 mounted on the central segment 20 to the axle 18 to reduce rotational friction as the yo-yo spins at the end of the string (not shown). The bearing 22 may comprise a roller bearing having an inner race 24 and an outer race 26. The yo-yo string (not shown) is looped about the outer surface 27 of the outer race 26.

Each of the yo-yo halves 10, 12 may be considered as having an inwardly facing surface, indicated generally at 28. A centrally located socket 30 may be formed in each of the yo-yo halves 10, 12, each socket 30 being open inwardly and receptive to a threaded insert 32 having internal threads 34. The insert 32 preferably is secured in the socket 30 by an interference fit and may be generally circular, hexagonal or other cross-section, with the hexagonal shape preferred. The configuration of the socket 30 and insert 32 should be such as to assure a secure attachment between the socket 30 and its associated yo-yo half 10, 12. It should be understood that the principles of the invention may be incorporated in a yo-yo in which the ends of the axle are threadably connected to the yo-yo halves 10, 12, either directly or by other suitable means. The connection between the end of the axle and the yo-yo halves should be such as to enable the gap G between the yo-yo halves to be varied by relative rotation of the yo-yo halves with respect to each other. In the illustrative embodiment, it will be appreciated that the gap G will vary depending on the extent to which the threaded ends 14, 16 of the axle 18 are threaded into the threaded inserts 32.

In accordance with the principles of the invention, the relative position of the yo-yo halves 10, 12 with respect to the axle 18 and each other is maintained by frictional forces that, while sufficient to maintain a fixed relative angular position between the yo-yo halves 10, 12 when the device is in use, nevertheless may be easily manually overcome simply by rotating the yo-yo halves 10, 12 relative to each other. Thereafter, the adjusted orientation is maintained during use by the applied frictional forces. The periphery of each of the yo-yo halves may be provided with a rubber ring 11 received in a peripheral groove 13 of the yo-yo half. The rubber facilitates the frictional grip that the user may apply to the yo-yo halves when adjusting their relative angular position. It also protects the periphery of the yo-yo from damage, as when performing certain tricks in which the periphery is expected to contact other surfaces, such as in "walking the dog".

In the illustrated embodiment of the invention, the frictional force for maintaining the angular orientation of the yo-yo halves with respect to themselves and the axle 18 may be effected by a series of Bellville washers indicated collectively at 36. The Bellville washers 36 are dished and may be considered as having a concave side 38 and a convex side 40. The dished configuration of the Bellville washers enables them to function as a compression spring, that is, when compressed from its normally dished shape toward a flattened shape, the washer will return to its dished shape when the compression force is removed. The arrangement of Bellville washers is selected, in the illustrative embodiment, to cooperate with the bearing 22 to permit free rotation of the outer race 26 with respect to the inner race 24 of the bearing 22. To that end, the illustrative embodiment includes an arrangement, on each side of the bearing 22, of an inner Bellville washer 36*a*, an intermediate Bellville washer 36*b* and an outer Bellville washer 36*c*. An O-ring 42 may be provided on each end of the axle to retain the Bellville washers 36 on the axle 18 in the event that the yo-yo is disassembled for example, to undo an inadvertently knotted string or for any other reason. It should be understood, however, that the present invention does not require or contemplate disassembly of the yo-yo in order to adjust the width of the gap.

The Bellville washers 36 are arranged so that the convex side 40 of the innermost of the Bellville washers 36*a* will face inwardly toward the bearing 22. So positioned, only the radially inwardly disposed region 44 of the Bellville washer 36*a* will bear against the lateral surface 46 of the inner race 24. The more radially outward regions 48 of the Bellville washer 36*a* will be dished outwardly and away from the outer race 26 so as not to interfere with rotation of the outer race 26 about the inner race 24. The Bellville washers should be arranged sequentially and in opposition to each other, that is, with like concave or convex sides of adjacent washers facing each other. Thus, as shown in the drawings, the concave side 38 of the inner most Bellville washer 36*a* faces the concave side of the intermediate Bellville washer 36*b* and the convex side of the intermediate Bellville washer 36*b* faces the concave side of the outer washer 36*c*. Thus, each pair of adjacent washers 36 will bear against each other either at their outer or inner peripheries 50, 52, respectively. By orienting the adjacent washers in opposition to each other, the arrangement provides adequate range of axial motion of the yo-yo halves 10, 12 toward and away from each other, while maintaining sufficient outward bias on the yo-yo half to develop the necessary friction between the surfaces of the threads of the axle 18 and the internal threads 34 of the insert 32. The outermost washer 36*c* preferably is oriented with its concave side 38 facing outwardly. Thus, the outer periphery 50 of the outer Bellville washer 36*c* engages an inwardly facing surface of the yo-yo half assembly, such as the surface 54 of the threaded insert. By way of example, a suitable Bellville washer for use in the invention may be formed from heat treated spring steel having a Rockwell hardness in the range of 44 to 48. The washer may have an outer diameter of 0.315 inch, an inner diameter of 0.165 inch. The spring steel from which it is formed preferably has a thickness of about 0.016 inch. The dished washer preferably has a height of the order of 0.028 inch. Such washers are commercially available from the Willie Washer Mfg. Co. in Elk Grove, Ill.

Figure 2:
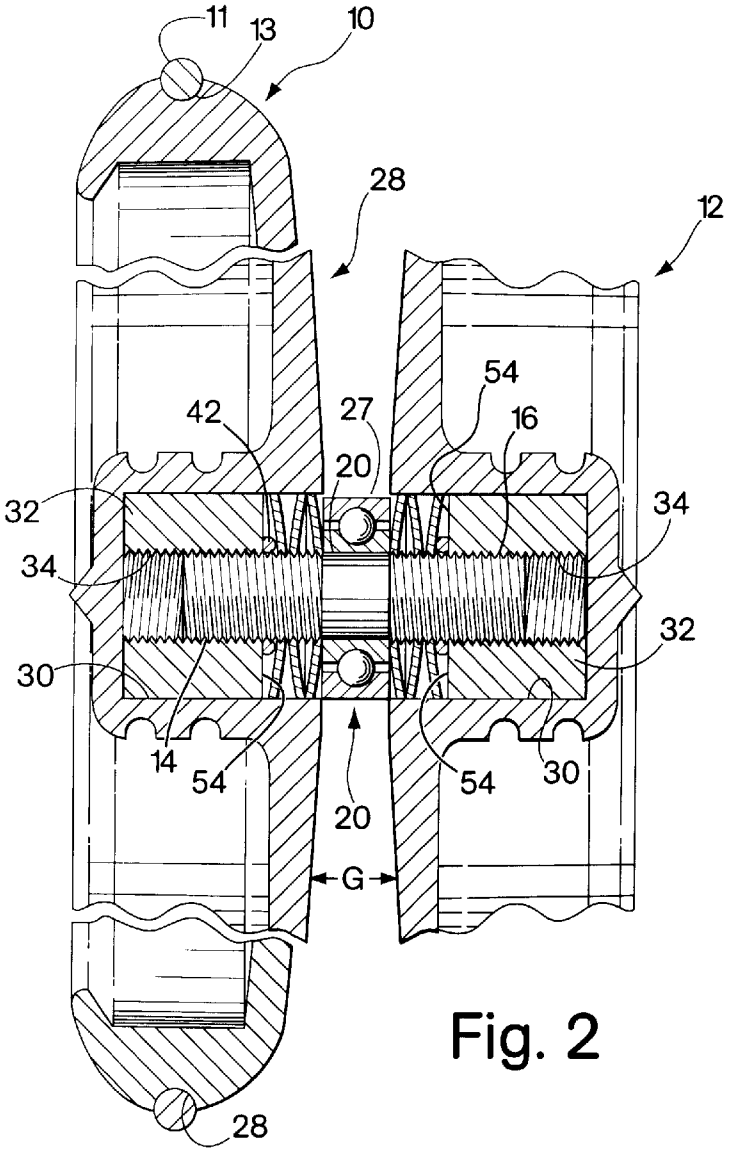
FIG. 2 is a fragmented, sectional illustration of the internal components of the yo-yo as shown in FIG. 1.
Figure 4:
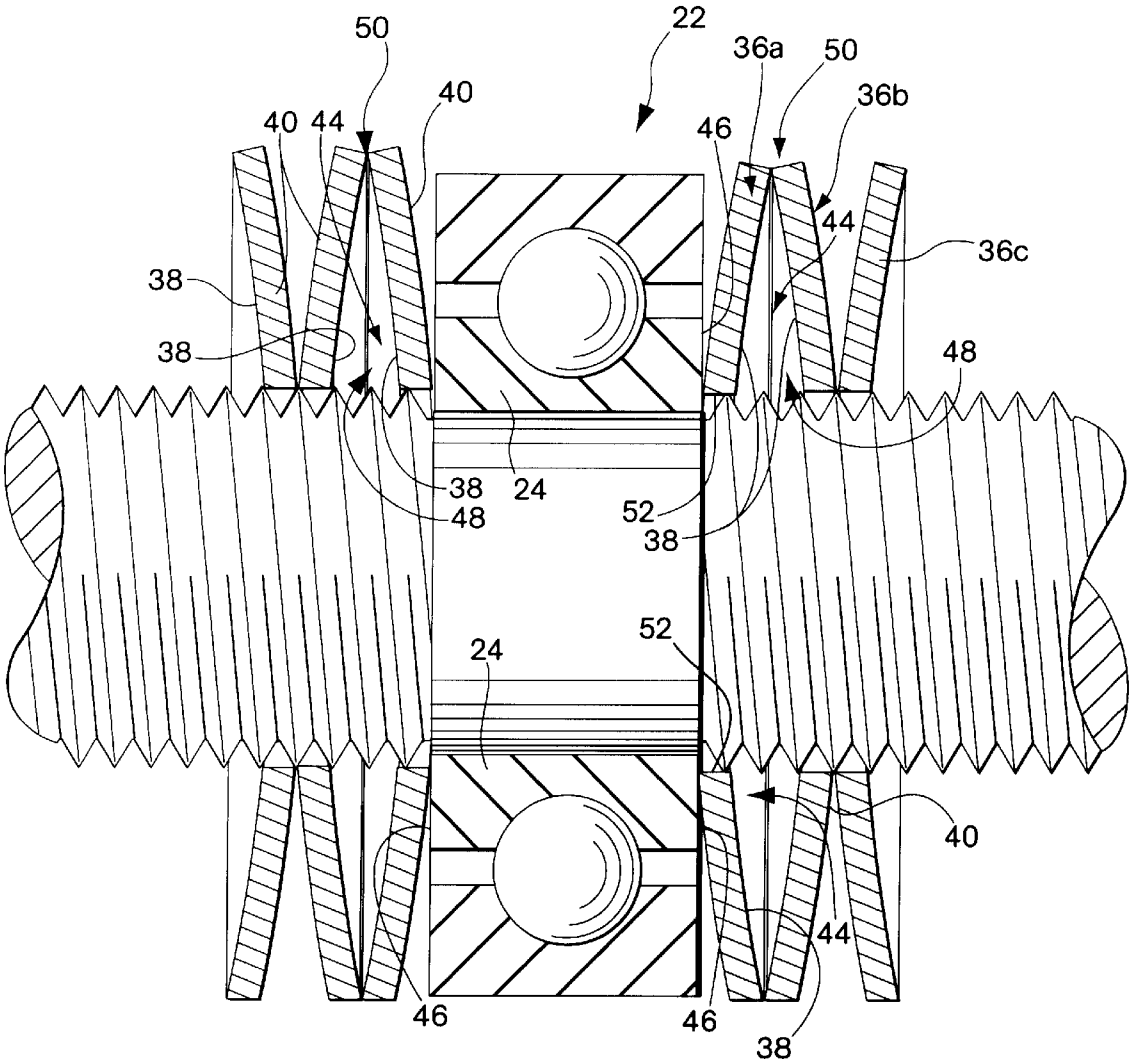
FIG. 4 is a greatly enlarged sectional illustration of the Bellville washers, a portion of the axle and the bearing.

In the illustrative embodiment shown in FIG. 2, the O-rings are compressed between the outermost washers 36*c* and the inwardly facing surfaces 54 of the threaded insert 32. In this configuration, the O-ring should be sufficiently soft and resilient as to permit such compression, preferably so that the outer periphery 50 of the outer Bellville washer 36*c* can firmly bear against the inwardly facing surface 54 of the threaded insert 32. In this embodiment O-ring 42 should be sufficiently resilient as to maintain its washer-retaining function, described above, even after it has been firmly compressed for an extended period of time.

Figure 3:
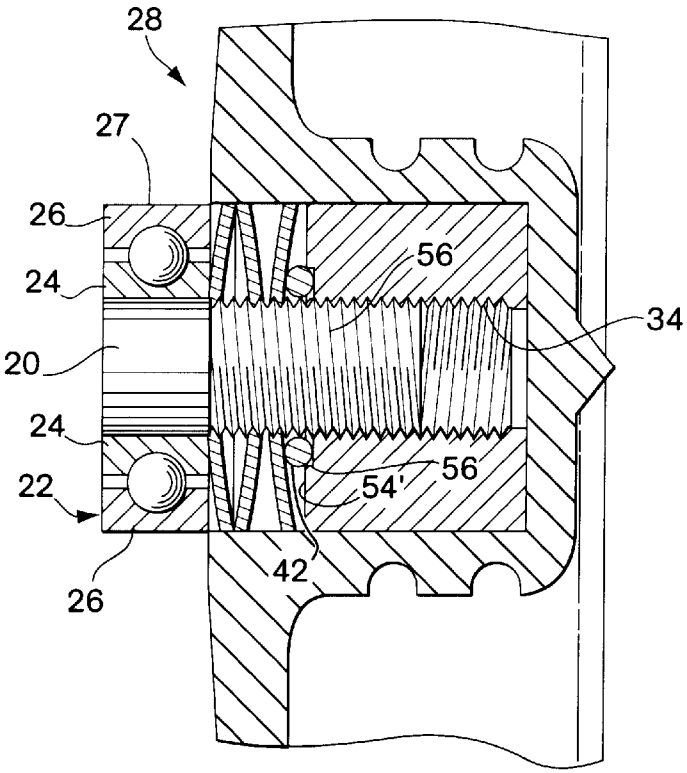
FIG. 3 is a fragmented, sectional illustration of a portion of a yo-yo embodying a modified form of the embodiment of the invention shown in FIGS. 1 and 2.

In a modified embodiment, as shown in FIG. 3, the inwardly facing 54 surface of the threaded insert 32 may be provided with a recessed annular shoulder 56 adapted to receive at least part of the O-ring 42 so that high compression and possible permanent distortion or rupture of the O-ring may be avoided.

Figure 5:
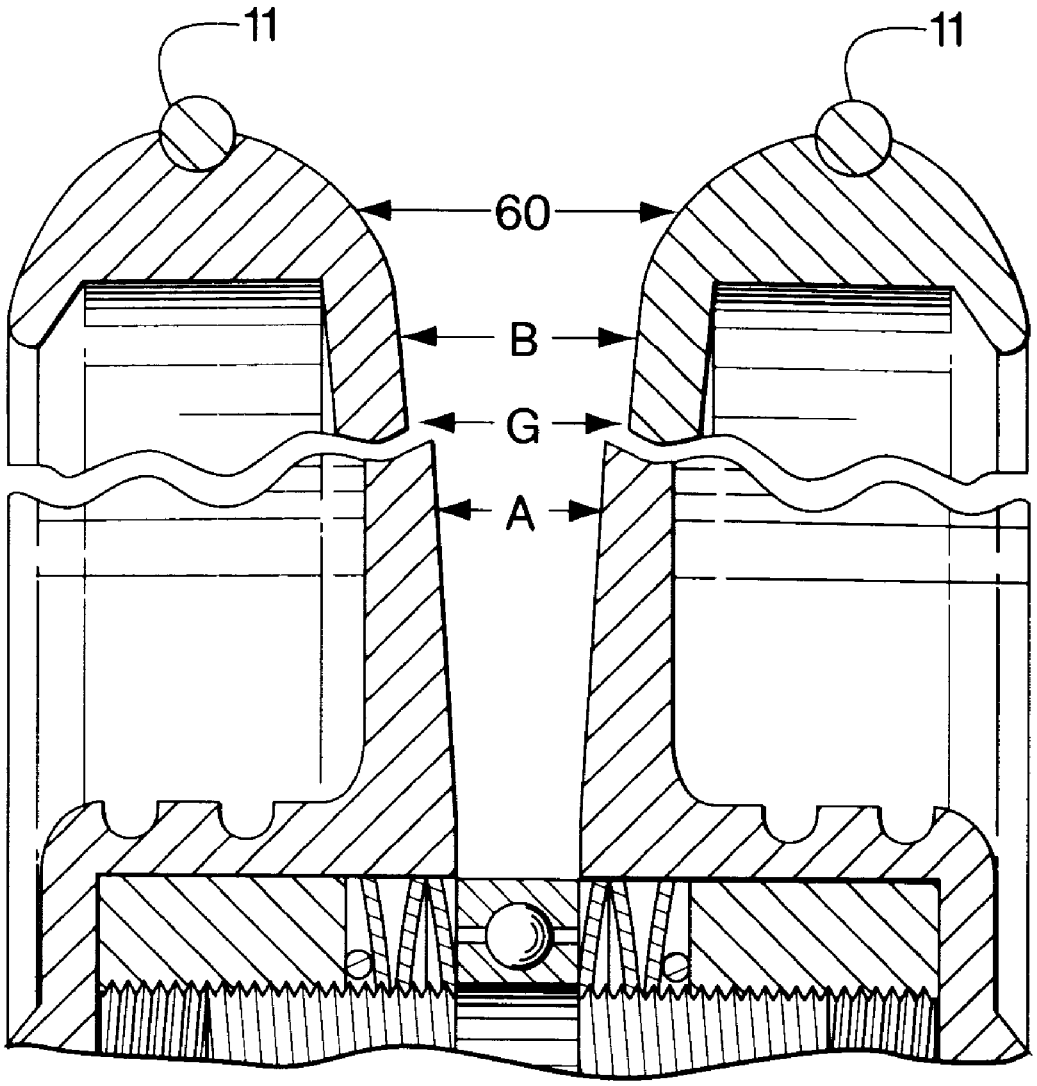
FIG. 5 is an enlarged illustration of the angular configuration of the inwardly facing surfaces of the yo-yo halves.

In another aspect of the invention, the inwardly facing surfaces 28 of the yo-yo halves are arranged to facilitate frictional engagement of the yo-yo string with those surfaces while maintaining the ability of the yo-yo to be used to perform string tricks such as, for example, "brain twister". Generally, string tricks are facilitated by having a relatively wider gap G by which the gap can be dynamically aligned with an intermediate portion of the yo-yo string to support the yo-yo on that intermediate portion while still spinning. In this aspect of the invention both objectives can be achieved by forming the inner surfaces of the yo-yo halves to define a progressively increasing gap width in a radially outward direction. Thus, each of the yo-yo halves 10, 12 may be considered with its inwardly facing surface 28 as having regions of an inner annular face 28*a* and outer annular face 28*b*. The outer periphery of the outer annular face 28*b* should be considered as terminating at the region where the inner face makes a transition to the outer peripheral contour of the yo-yo half. Such region is indicated approximately at 60 in FIGS. 1 and 5. The transition between the inner annular face 28*a* and outer annular face 28*b* is represented approximately in phantom at 31 in FIG. 1. The transition region 31 may be considered as being defined by a radius that extends from about the axis of the yo-yo half to a region that is about half the radius of the inner face 28. Thus, as illustrated in FIG. 1, the radial segments 28*a* and 28*b* may be approximately equal in radial extent. As shown in further diagrammatic detail in FIG. 5, the inner annular faces 28*a* of the yo-yo halves 10, 12 are configured to define a first narrower angle A, and consequently smaller gap G, than the outer annular surfaces 28*b*. The inner and outer annular surfaces 28*a*, 28*b* may be relatively flat or somewhat curved. In either case, the inner annular surfaces 28*a* preferably may define a gap G having an angle of about 3½° with the outer annular surfaces 28*b* defining a second, slightly greater gap angle B, of the order of about 4½°. Thus, the gap G is narrower in its more radially inward regions than in its more radially outward regions. The narrowed inner region facilitates frictional engagement with the string while the somewhat widened gap at the radially outer regions facilitates the performance of string tricks.

From the foregoing it will be appreciated that the invention provides an adjustable gap yo-yo in which the gap between the yo-yo halves can be quickly, easily and precisely adjusted without significant interruption in play. The yo-yo does not have to be disassembled. No tools are required in order to effect the adjustment.

It should be understood that the foregoing description of the invention is intended merely to be illustrative thereof and other embodiments, modifications and equivalents may be apparent to those skilled in the art without departing from its spirit.

Having thus described the invention, what I desire to claim and secure by Letters Patent is:

1. A yo-yo comprising:

an axle;

a pair of yo-yo halves threadably connected to the axle to enable the space between the yo-yo halves to be adjusted by relative rotation of at least one of the yo-yo halves with respect to the other;

the yo-yo halves being biased continually apart by a compression spring mounted on the axle, under a force sufficient to generate frictional engagement between the yo-yo halves and the axle to maintain the relative angular position of the yo-yo halves with respect to each other when the yo-yo is in use, the degree of frictional engagement being not so great as to preclude manual adjustment of the relative position of the yo-yo halves; and wherein the compression spring comprises at least two Bellville washers mounted in opposition to each other.

2. A yo-yo as defined in claim 1 further comprising a rotational bearing mounted on the axle, the biasing being effected between the bearing and an inwardly facing surface of the yo-yo halves.

3. A yo-yo as defined in claim 2 wherein the compression spring is compressed between the bearing and the yo-yo half.

4. A yo-yo as defined in claim 2 wherein the bearing comprises an inner race and an outer race;

the force of the compression spring being applied to the inner race and to the yo-yo half.

5. A yo-yo as defined in claim 1 further comprising each of the yo-yo halves comprises a body and a threaded insert secured to the body, the threaded insert having an inwardly facing opening having internal threads engageable with the threads on the axle, the compression spring being engage able with the threaded insert.

6. A yo-yo as defined in claim 5 further comprising:

a rotational bearing mounted on the axle;

a plurality of Bellville washers disposed on the axle on each side of the bearing, the innermost of the Bellville washers bearing against the bearing and the outermost of the Bellville washers bearing against its associated insert.

7. A yo-yo as defined in claim 6 wherein the bearing comprises an inner race and an outer race, the inner of the Bellville washers being oriented with its concave side facing the bearing and in engagement only with the inner race of the bearing.

8. A yo-yo as defined in claim 7 wherein the remainder of the Bellville washers being arranged in serial opposition with respect to and against each other.

9. A yo-yo as defined in claim 8 further comprising:

a retaining member mounted on each end of the axle to retain the Bellville washers on the axle in the event of disassembly of the yo-yo.

10. A yo-yo as defined in claim 9 further comprising:

an annular shoulder formed on the inwardly facing surface of the threaded inserts adapted to receive the retaining member.

11. A yo-yo comprising:

an axle;

a pair of yo-yo halves threadably connected to the axle to enable the space between the yo-yo halves to be adjusted by relative rotation of at least one of the yo-yo halves with respect to the other; and the yo-yo halves being biased continually apart by a compression spring mounted on the axle, under a force sufficient to generate frictional engagement between the yo-yo halves and the axle sufficient to maintain the relative angular position of the yo-yo halves with respect to each other when the yo-yo is in use, the degree of frictional engagement being not so great as to preclude manual adjustment of the relative position of the yo-yo halves; and a retaining member on the axle to retain the biasing member on the axle.

12. A yo-yo as defined in claim 11 wherein the retaining member comprises an O-ring.

13. A yo-yo as defined in either one of claims 11 or 12 further comprising:

an annular shoulder formed in an inwardly facing surface of the yo-yo half to receive the retaining member.

* * * * *